US007023327B1

(12) United States Patent
Chen

(10) Patent No.: US 7,023,327 B1
(45) Date of Patent: Apr. 4, 2006

(54) REMOTE DOORBELL CHIME EXTENDER

(76) Inventor: Ching Cheng Chen, 300 N. Michigan St., Suite 400, South Bend, IN (US) 46601

( * ) Notice: Subject to any disclaimer, the term of this patent is extended or adjusted under 35 U.S.C. 154(b) by 156 days.

(21) Appl. No.: 10/623,820

(22) Filed: Jul. 21, 2003

(51) Int. Cl.
*G10K 1/06* (2006.01)

(52) U.S. Cl. ..... 340/392.5; 340/326

(58) Field of Classification Search ..... 340/392.5, 340/392.1, 393.3, 392.4
See application file for complete search history.

(56) References Cited

U.S. PATENT DOCUMENTS

| | | | | |
|---|---|---|---|---|
| 3,017,623 | A | 1/1962 | Bishofberger | |
| 4,523,193 | A | 6/1985 | Levinson | |
| 5,428,388 | A | 6/1995 | von Bauer | |
| 6,175,298 | B1 | 1/2001 | Xydis | |
| 6,414,589 | B1 * | 7/2002 | Angott et al. | 340/326 |
| 6,420,860 | B1 * | 7/2002 | Yamaguchi | 323/288 |
| 6,545,595 | B1 | 4/2003 | Xydis | |

* cited by examiner

*Primary Examiner*—Daniel Wu
*Assistant Examiner*—Son Tang

(57) ABSTRACT

A remote chime unit and signal extender assembly are connectable to the circuitry of a primary doorbell system allowing the remote chime to be activated simultaneously with the primary doorbell chime from a stored voltage source.

5 Claims, 1 Drawing Sheet

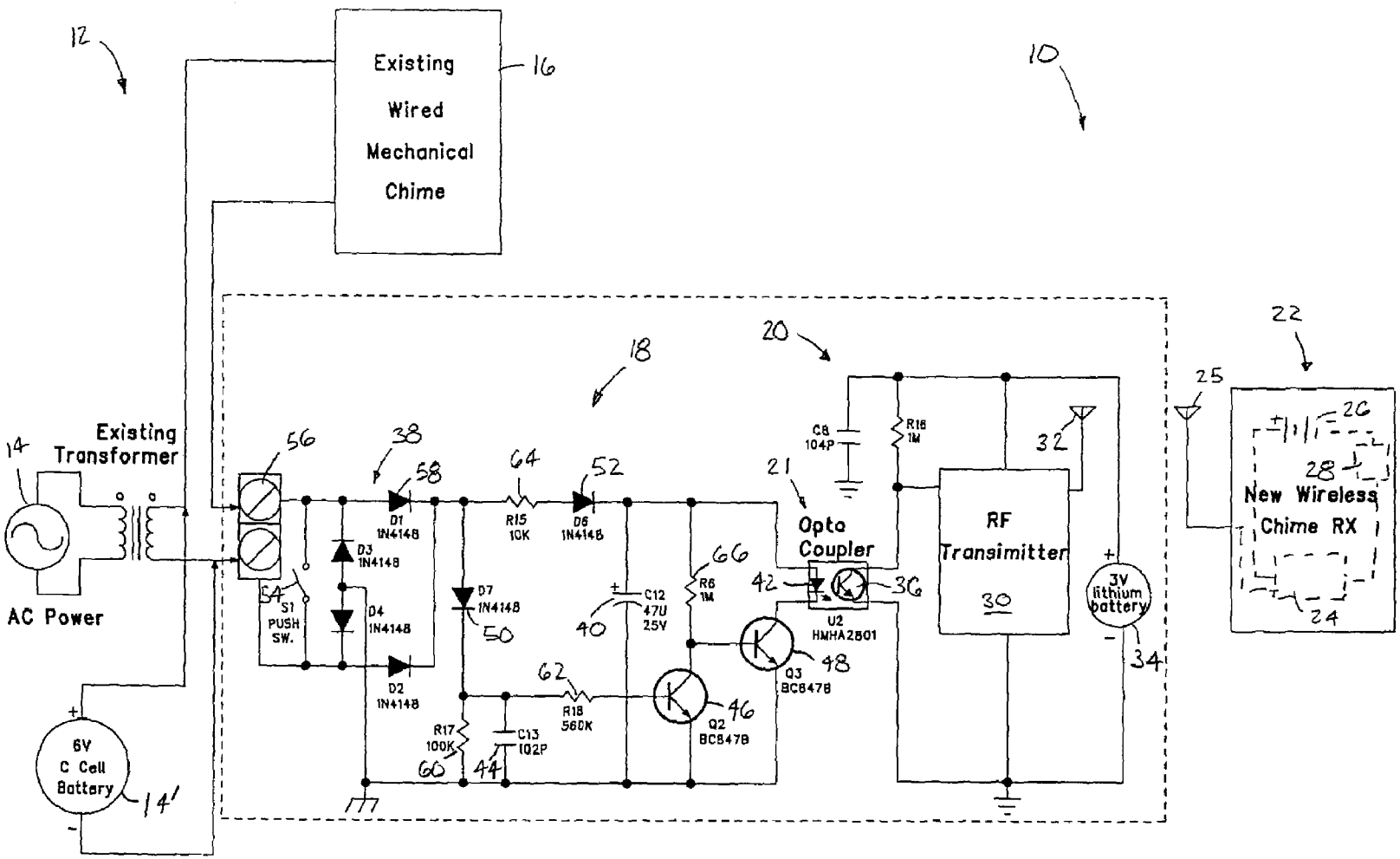
New Wireless Chime RX
RF Transmitter
3V lithium battery
Opto Coupler
U2 HMHA2801
Q3 BC847B
Q2 BC847B
R18 1M
C8 104P
R6 1M
C12 47U 25V
D6 1N4148
R15 10K
D7 1N4148
R18 560K
C13 102P
R17 100K
D1 1N4148
D3 1N4148
D4 1N4148
D2 1N4148
S1 PUSH SW.
Existing Wired Mechanical Chime
Existing Transformer
AC Power
6V C Cell Battery

REMOTE DOORBELL CHIME EXTENDER

FIELD OF THE INVENTION

The invention relates to a remote wireless doorbell chime adaptable for use with a doorbell system.

BACKGROUND OF THE INVENTION

In a home, business, or other setting having a doorbell with a main or primary chime unit, it can be desirable to have a second chime in a remote location of the building, such as the basement for example. Because the remote chime is often installed after the original doorbell is installed, it is usually easier to use a wireless radio frequency (RF) transmitter to transmit an 'on' signal from the main doorbell actuation circuit to the remote chime than to install wiring connecting the remote chime to the doorbell actuation circuit.

Remote chimes activated by an RF transmitter connected to the primary doorbell circuit are known. For example, U.S. Pat. Nos. 4,523,193 and 6,414,589 both disclose a remote doorbell chime including an RF transmitter connected to the main doorbell wiring and a corresponding receiver connected to the remote chime. The '193 patent includes a full wave rectifier connected across the primary doorbell AC circuit outputting DC to a transmitter circuit including a transmitter, a filter capacitor, and a zener diode. The '589 patent includes parallel switches for simultaneously completing a primary doorbell circuit and an RF transmitter circuit in parallel. It would be desirable, therefore, to have a switching mechanism for activating an RF transmitter to activate a remote chime unit simultaneously with the primary chime unit which does not draw current away from the primary chime unit during remote chime use.

SUMMARY OF THE INVENTION

A remote chime assembly for connection to a primary doorbell assembly is disclosed whereby activation of the primary doorbell chime will also activate the remote chime. The remote chime assembly includes a remote chime with a signal receiver, a signal transmitter for transmitting a signal to the receiver, and a transmitter actuator connected to the primary doorbell assembly for independently activating the transmitter with stored electrical energy.

An object of the invention is to provide a remote chime adaptable for use with a primary doorbell such that the remote chime will be activated when the primary doorbell is activated.

BRIEF DESCRIPTION OF THE DRAWINGS

These and other aspects of the invention will be apparent from the following description, with reference to the accompanying drawings, in which FIG. 1 is a schematic diagram of the primary doorbell, transmitter actuator, transmitter, and remote chime circuits.

DETAILED DESCRIPTION

Referring now to the drawing in which the preferred embodiment is diagramed, a doorbell chime extender 10 is connected to a primary doorbell 12 such as would commonly be found in a residence. Primary doorbell 12 is a common doorbell assembly, which includes a primary power source 14 or 14' connected by an appropriate electrical circuit to a primary chime 16. Primary power may be either stepped down AC from the main building power source 14 or a back up DC battery power source 14'. The primary doorbell circuit is such that a normally open switch, usually a push button, may be closed to complete the circuit and thereby activate the primary chime, in a manner well known in the art.

Chime extender 10 is for producing an audio signal in a remote location from the primary chime 16 when primary doorbell 12 is activated. Chime extender 10 includes a power circuit 18 connected to the primary doorbell circuit, a radio frequency (RF) transmitter circuit 20 connected to the power circuit by an opto-coupler 21, and a remote chime unit 22 activated in response to a signal sent by the RF transmitter.

Remote chime unit 22 is for producing an audio alert in a remote location when the primary doorbell is activated. Remote chime unit 22 may be any of several known types which generally include an RF receiver 24 with an antenna 25, a power source 26, and a sound generator 28. Receiver 24 is tuned to receive signals from transmitter 20 such that when the transmitter is activated to transmit a signal, the receiver will activate sound generator 28. Receiver 24 and sound generator 28 are both powered by power source 26. Remote chime unit 22 may be powered by either a battery as shown, or from the building's main electric.

Transmitter circuit 20 is for transmitting an activation signal to receiver 24 in remote chime unit 22 when the primary doorbell is activated. Transmitter circuit 20 includes an RF signal transmitter 30, an antenna 32, and a power source 34 appropriately connected to activate the signal transmitter when opto-coupler 21 is activated. Opto-coupler 21 includes a transistor 36 connected to transmitter 30. Transmitter 30 is activated by powering transistor 36 in opto-coupler 21. Transmitter 30 then produces a signal which is transmitted by antenna 32 to remote chime unit 22. Power source 34 is preferably a lithium battery, but other types of power sources could be used as appropriate to power different types of transmitters.

Power circuit 18 powers transmitter 30 when the doorbell button for the primary doorbell 12 is pushed. Power circuit 18 includes a full wave rectifier 38, a storage capacitor 40, a filter capacitor 44, a pair of switch transistors 46, 48, a pair of biasing diodes 50, 52, a mechanical push button switch 54, and connectors 56. Power circuit 18 is connected across the electrical circuit of primary doorbell 12 in place of the primary doorbell's usual push button switch using connectors 56. Normally open mechanical push switch 54 is connected across connector 56 to actuate the primary doorbell circuit when switch 54 is closed. Full wave rectifier 38 is connected across connectors 56 in parallel with switch 54 such that current from AC power source 14 or battery 14' will flow into the rectifier when the switch is open. Rectifier 38 includes rectifying diodes 58 for providing a DC output. Power circuit 18 may be adapted for use with a primary doorbell 12 powered by either or both AC or various DC power sources with only minor design adjustments to the various circuit subcomponents described herein. When switch 54 is open, power circuit 18 is in standby mode with voltage from primary doorbell power source 14, 14' being stored in capacitor 40.

Transistor 46 and transistor 48 are connected in cascading series to each other whereby the base of transistor 48 is connected to the collector of transistor 46. In this manner, when transistor 46 is powered on, transistor 48 is off. Likewise, when transistor 46 is off, transistor 48 is powered on, acting in a see-saw fashion. The base of transistor 46 is connected to the output rectifier 38. Biasing voltage from rectifier 38 passes through a diode 50 and is divided by resistors 60, 62 and filtered by capacitor 44 to turn transistor 46 on. Storage capacitor 40 is connected to the output of rectifier 38 through a blocking diode 52 and resistor 64 Capacitor 40 is charged when switch 54 is open. Transistor 48 at its collector/emitter is connected in series between LED 42 in opto-coupler 21 and storage capacitor 40.

When power circuit 18 is in standby mode with switch 54 open, the output from rectifier 38 turns transistor 46 to bias transistor 48 off. In this state, LED 42 is off, and storage capacitor 40 is charged.

Closing switch 54 causes an interruption in voltage to power circuit 18 and the activation of primary chime 16 with the power circuit assuming its activation mode. In this activation mode, current from the primary current source 14, 14' is no longer supplied to transistor 46, which causes transistor 46 to power off. The stored charge or voltage in storage capacitor 40 passes through resistor 66 to the base of transistor 48, which causes transistor 48 to turn on to complete the circuit from the storage capacitor to LED 42 of opto-coupler 21. The discharge from capacitor 40 lights LED 42, which causes opto-coupler transistor 36 to turn on. When transistor 36 is turned on, transmitter 30 is activated to transmit a signal to activate remote chime unit 22 as herein before described. If switch 54 is held closed for a relatively long period of time, storage capacitor 40 may completely discharge, at which time LED 42 would turn off. When LED 42 turns off, transmitter 30 stops transmitting a signal to remote chime unit 22, but by that time the remote chime unit has already announced the presence of a person at the door.

When switch 54 is re-opened by releasing the doorbell button, power circuit 18 returns to standby mode, allowing storage capacitor 40 to recharge. Power circuit 18 is then ready to activate remote chime unit 22 the next time the doorbell button is pressed.

The detailed description related herein is only meant to exemplify the preferred embodiment of the invention to enable those skilled in the art to make and use it. It is not intended to be a limitation from other minor and obvious variations on the embodiments described, all of which variations are expressly included herein.

I claim:

1. A remote chime assembly for connection to a primary electric doorbell including a primary activation circuit connected to a first power source, said assembly comprising:

a remote chime including a signal receiver, said receiver for causing said chime to produce an audio signal when the receiver receives an activation signal;

a transmitter for transmitting said activation signal to said receiver; and a transmitter actuator connectable to said doorbell primary activation circuit, said transmitter actuator including voltage storing means connected to the transmitter for independently actuating the transmitter with its stored voltage in conjunction with activation of said doorbell, said stored voltage accessed from said first power source a second power source connected to said transmitter for powering the transmitter independently of said first doorbell power source.

2. The remote chime assembly of claim 1 wherein said transmitter actuator is connected to said first power source and includes a standby mode and an activation mode, said transmitter actuator being in its standby mode when said primary doorbell is not activated and in its activation mode when the primary doorbell is activated, said voltage storing means accumulating said stored voltage from said first power source when in said standby mode and discharging said stored voltage to activate said transmitter when in said activation mode.

3. The remote chime assembly of claim 2 and further comprising:

an opto-coupler connecting said transmitter and said transmitter actuator, wherein activation of said opto-coupler by said transmitter actuator causes the transmitter to transmit said activation signal to said receiver.

4. The remote chime assembly of claim 3 wherein said transmitter actuator includes a first transistor and a second transistor each having on and off states, the collector of said first transistor connected to the base of said second transistor, said first transistor in its on state when said second transistor is in its off state, said first transistor in its off state when said second transistor is in its on state, said second transistor further connected to said opto-coupler and said voltage storage means such that when the second transistor is turned on, the opto-coupler is activated by said stored voltage in the voltage storage means.

5. The remote chime assembly of claim 4 wherein the base of said first transistor is being biased by said first power source when said transmitter actuator is in its said standby mode to place said first transistor in its on state, said first transistor being isolated from said first power source and in its off state when said transmitter activator is in its said activation mode.

* * * * *